US006680567B2

(12) United States Patent
Sugawara et al.

(10) Patent No.: US 6,680,567 B2
(45) Date of Patent: Jan. 20, 2004

(54) GLASS BULB FOR A CATHODE RAY TUBE AND CATHODE RAY TUBE

(75) Inventors: Tsunehiko Sugawara, Funabashi (JP); Naoya Shimizu, Funabashi (JP); Toshihide Murakami, Funabashi (JP)

(73) Assignees: Asahi Glass Company, Limited, Tokyo (JP); Mitsubishi Denki Kabushiki Kaisha, Tokyo (JP)

( * ) Notice: Subject to any disclaimer, the term of this patent is extended or adjusted under 35 U.S.C. 154(b) by 88 days.

(21) Appl. No.: 10/094,652

(22) Filed: Mar. 12, 2002

(65) Prior Publication Data

US 2002/0185959 A1 Dec. 12, 2002

(30) Foreign Application Priority Data

Mar. 12, 2001 (JP) ..... 2001-069100

(51) Int. Cl.[7] ..... H01J 31/00

(52) U.S. Cl. ..... 313/477 R; 313/402; 313/480; 220/2.1 A

(58) Field of Search ..... 313/477 R, 474, 313/402, 461, 479, 473, 480; 220/2.1 A, 2.1 R, 2.3 A; 65/60, 63, 65, 69

(56) References Cited

U.S. PATENT DOCUMENTS

| | | | | |
|---|---|---|---|---|
| 4,904,899 A | | 2/1990 | Nakata et al. | 313/477 R |
| 5,445,285 A | | 8/1995 | Sugawara et al. | 220/21 A |
| 5,536,995 A | | 7/1996 | Sugawara et al. | 313/477 R |
| 5,837,026 A | | 11/1998 | Sugawara et al. | 65/66 |
| 5,925,977 A | * | 7/1999 | Sugawara et al. | 313/477 R |
| 5,964,364 A | | 10/1999 | Shimizu et al. | 220/21 A |
| RE36,838 E | | 8/2000 | Sugawara et al. | 313/477 R |
| 6,121,723 A | | 9/2000 | Sugawara et al. | 313/477 R |
| 6,236,151 B1 | | 5/2001 | Murakami et al. | 313/402 |
| 6,448,707 B1 | * | 9/2002 | Yoon et al. | 313/480 |
| 6,566,802 B1 | * | 5/2003 | Jeong | 313/477 R |

FOREIGN PATENT DOCUMENTS

| | | |
|---|---|---|
| GB | 2 335 788 | 9/1999 |
| WO | WO 00/41204 | 7/2000 |

OTHER PUBLICATIONS

Patent Abstracts of Japan, JP 2001–167718, Jun. 22, 2001.
Patent Abstracts of Japan, JP 11–067124, Mar. 9, 1999.
Patent Abstracts of Japan, JP 7–142012, Jun. 2, 1995.

* cited by examiner

*Primary Examiner*—Wilson Lee
(74) *Attorney, Agent, or Firm*—Oblon, Spivak, McClelland, Maier & Neustadt, P.C.

(57) ABSTRACT

When a face portion 4 of a panel portion 1 has a central wall thickness of $T_C$, an end of a useful screen area has a wall thickness of $T_L$, a sealing end surface of a skirt portion has is a width of $T_S$, and an intermediate part of a body portion 7 of a funnel portion 2 is $T_F$, there are established the formulas of; $T_L/T_C \geqq 1.70$, $T_S/T_L = 0.43–0.50$, and $T_F/T_C = 0.37–0.49$, and a strengthened compressive stress of 5–14 MPa is applied to a side of the skirt portion.

2 Claims, 2 Drawing Sheets

GLASS BULB FOR A CATHODE RAY TUBE AND CATHODE RAY TUBE

The present invention relates to a glass bulb for a cathode ray tube and a cathode ray tube, wherein a face portion has a substantially flat outer surface, and the face portion has a drastically changed wall thickness distribution.

In cathode ray tubes, the envelope comprises a glass bulb, which includes a panel portion for displaying an image, and a funnel portion formed in a funnel shape and having one end provided with a neck portion for housing an electron gun. The panel portion has a substantially box-shaped form and comprises a substantially rectangular face portion for providing a screen (screen area) and a skirt portion extending substantially vertically from a peripheral edge of the face portion to define a side wall.

In recent years, as the panel portion has been employed one wherein the face portion has a substantially flat outer surface and a concave inner surface, and is thermally strengthened to improve strength. In general, in the case of a panel portion for a cathode ray tube with a shadow mask employed therein, in order that a shadow mask can easily control electron beams from an electron gun to project the electron beams on a fluorescent screen on an inner surface of a face portion, or in order that the cathode ray tube can increase strength for the purpose of improving anti-implosion properties, the panel portion has an extremely greater wall thickness in a peripheral portion of the face portion than a central portion thereof. In other words, the panel portion has a wall thickness distribution in the face portion, wherein the wall thickness increases from the central portion toward the peripheral portion. For example, JP-A-11-67124 discloses that the wall thickness of the peripheral portion is not less than 1.5 times that of the central portion.

However, when the panel portion is joined to the funnel portion through an end surface of the skirt portion by frit glass, and the panel portion and the funnel portion thus joined are subjected to a heat treatment process (an evacuation process) to produce a cathode ray tube, the generation of a great thermal stress due to the wall thickness distribution in the face portion has caused fracture, lowering productivity.

When the panel portion has a drastically changed wall thickness distribution in the face portion as stated earlier, the difference in the wall thickness between the central portion and the peripheral portion of the face portion produces a great thermal stress throughout an area from an edge of the face portion to a blend portion and the skirt portion in the heat treatment process. When the panel is equal or is little different in the wall thickness distribution between the central portion and the peripheral portion of the face portion, no thermal stress raises a serious problem. However, in the case of a cathode ray tube wherein the useful screen area has a diagonal diameter of 60 cm, and the wall thickness of the peripheral portion in the face portion is beyond 1.7 times that of the central portion for instance, the thermal stress generated in the panel portion reaches 30–40 MPa. Glass exponentially increases the probability of occurrence of breakage in the range covering these stress values. This means that a slight increase in the thermal stress introduces a significant increase in the occurrence of fracture, greatly adversely affecting productivity.

Although it is the most effective to minimize the non-uniformity in the wall thickness distribution of the face portion in order to reduce the thermal stress, it is impossible to modify the shape of the inner and outer surfaces of the face portion in simple fashion since the shape is an important factor related to image quality or visibility.

In order to restrain the fracture in a glass bulb, there is a method for strengthening the panel portion by thermal strengthening. This method aims at restraining the crack by causing a thermally strengthened compressive stress to remain to cancel the thermal stress. In the case of the panel having a drastically changed wall thickness distribution in the face portion, it is difficult to introduce a strengthening stress in equal fashion since a difference in cooling between the face portion and the skirt portion is apt to be created when glass is cooled and solidified in a glass molding process. From this reason, it is impossible to obtain a sufficient effect to restrain the fracture of the glass bulb. Additionally, unexpected fracture is caused by the unnecessary tensile stress stated earlier in some cases.

Careful consideration has not been given to restraint on the thermal stress in designing the panel portion and the funnel portion. For example, when a thermally strengthened panel portion is combined with a funnel portion to produce a cathode ray tube, it is impossible to restrain the thermal stress in sufficient manner. Optimization has not been provided in terms of reduction in the weight of the glass bulb as well.

When a funnel portion is too thin, the imbalance in heat capacity between the funnel portion and a panel portion is exaggerated. In the heat treatment process, the funnel portion is heated or cooled too rapidly to generate an excess thermal stress, lowering the strength of the funnel portion. Since the funnel portion is provided with a great wall thickness so as to compensate the lowered strength in normal designing, no sufficient reduction in the weight of the funnel portion is provided as a matter of fact.

In consideration of the problems stated earlier, it is an object of the present invention to provide a lightweight glass bulb and a cathode ray tube with the glass bulb employed therein, wherein the thermal stress that is generated in a panel portion with a face portion having a drastically changed wall thickness distribution can be restrained as small as possible, and thermal strengthening is effectively applied.

The present invention has been proposed in consideration of the problems and has been attained by finding that investigation of the thermal stress, which is generated in a panel portion with a face portion having a drastically changed wall thickness distribution in a heat treatment process, reveals that when the wall thickness of a skirt portion and the wall thickness of a portion around the face portion are harmonized with each other, a restraining effect on the thermal stress can be provided, and that the thermal stress can be effectively cancelled to prevent fracture by applying a desired strengthened compressive stress to an outer surface region of a portion extending from an edge of the face portion on a short axis or a long axis to the skirt portion.

Additionally, the present invention has accomplished a lightweight glass bulb by finding that investigation of the relationship of the wall thickness of a funnel portion to the thermal stress generated in a panel portion and the stress generated by evacuating the inner side of a bulb (hereinbelow, referred to as "the vacuum stress") in a heat treatment process reveals that the wall thickness of the funnel portion is closely related to the thermal stress and the vacuum stress, and that when the wall thickness of the funnel portion is determined in a certain range with respect to the wall thickness of the face portion, the thermal stress can be restrained to prevent fracture while making the funnel portion thinner.

The present invention provides a glass bulb for a cathode ray tube, comprising a panel portion having a rectangular face portion and a skirt portion, the rectangular face portion having a substantially flat outer surface and a concave inner surface, the skirt portion extending substantially vertically from a peripheral edge of the face portion; a funnel portion having one end connected to the panel portion; and a neck portion having connected to the other end of the funnel portion; wherein at least the panel portion being thermally strengthened to apply a compressive stress thereto; the panel portion and the funnel portion satisfy the following conditions 1, 2, 3 and 4;

wherein the panel portion satisfies the following conditions at an edge portion of a useful screen area in the face portion on a short axis or an edge portion of a useful screen area in the face portion on a long axis, whichever has a greater wall thickness:

1) $1.70 \leqq T_L/T_C$, wherein $T_C$ is a central wall thickness of the face portion, and $T_L$ is a wall thickness of the useful screen area,
2) $5\ \text{MPa} \leqq |\sigma_C| \leqq 14\ \text{MPa}$, wherein $\sigma_C$ is the value of a strengthened compressive stress in at least an area of a side surface of the skirt portion in the vicinity of a mold match, and
3) $0.43 \leqq T_S/T_L \leqq 0.50$, wherein $T_S$ is a wall thickness of a sealing end surface of the skirt portion;

the funnel portion satisfies the following condition:

4) $0.37 \leqq T_F/T_C \leqq 0.49$, wherein $T_F$ is a wall thickness at a portion located at B/2 when B is the length of a body portion in the funnel portion in a bulb axis direction, the body portion extending from a sealing end to a yoke portion thereof.

Additionally, the present invention provides a cathode ray tube produced by employing the panel portion and the funnel portion.

In accordance with the present invention, the difference in cooling between the face portion and the skirt portion can be reduced, and imbalance in the strengthened compressive stress can be controlled to obtain a thermal strengthening effecting in sufficient fashion by specifying the shape of the skirt portion of the panel portion with the face portion having a drastically changed wall thickness distribution as stated earlier. In other words, the present invention is characterized in that the thermal stress that is generated due to the wall thickness distribution of the face portion can be restrained to prevent or reduce the occurrence of fracture in the panel portion by specifying the wall thickness of the skirt portion and the value of a compressive stress given by thermal strengthening.

In accordance with the present invention, the wall thickness of the skirt portion and the value of a compressive stress given by thermal strengthening are expediently specified on the short axis or the long axis of the face portion. This is because fracture is apt to be generated from such a portion. The reason is that although the wall thickness distribution of the face portion has the greatest wall thickness to the edge portion of the useful screen area, the edge portion is affected by the wall thickness distribution of the skirt portion to be subjected a great thermal stress especially on the short axis or the long axis and to make the tensile vacuum stress maximumized in a central portion of the portion around the face portion in a cathode ray tube production process. When the edge portion of the useful screen area on the short axis and the edge portion of the useful screen area on the long axis are compared to each other, the thermal stress is higher in the edge portion having a greater wall thickness.

From this viewpoint, it is important to specify the wall thickness of the skirt portion and the value of a thermally strengthened compressive stress on the edge portion of the useful screen area on the short axis or the edge portion of the useful screen area on the long axis, whichever has a greater wall thickness. Which of the edge portions has a greater wall thickness is variable and varies depending on the type or the shape of the panel portion since the wall thickness of the useful screen area on the short axis or the long axis is determined by an aspect ratio of the useful screen area or a design value given to the inner shape of the face portion. When a required wall thickness and the value of a thermally strengthened compressive stress have been specified with respect to the edge portion on the selected short axis or long axis, a required wall thickness and the value of a thermally strengthened compressive stress given to the other portions in the panel portion may be determined in the same way or be designed based on the conditions thus specified. This is also applicable to the funnel portion.

Figure 1:
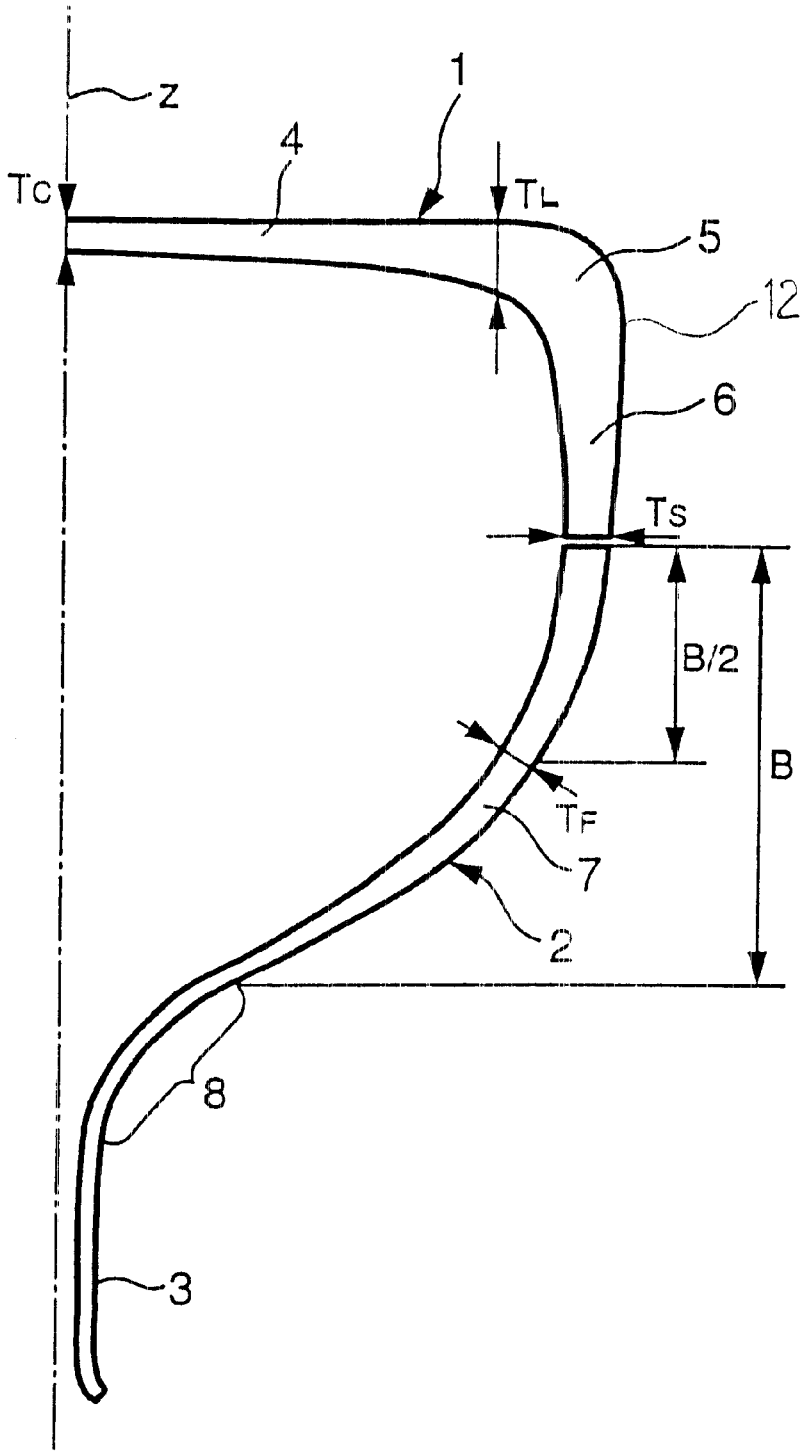
FIG. 1 is a cross-sectional view of the glass bulb for a cathode ray tube according to an embodiment of the present invention, taken along line I—I of FIG. 2.
Figure 2:
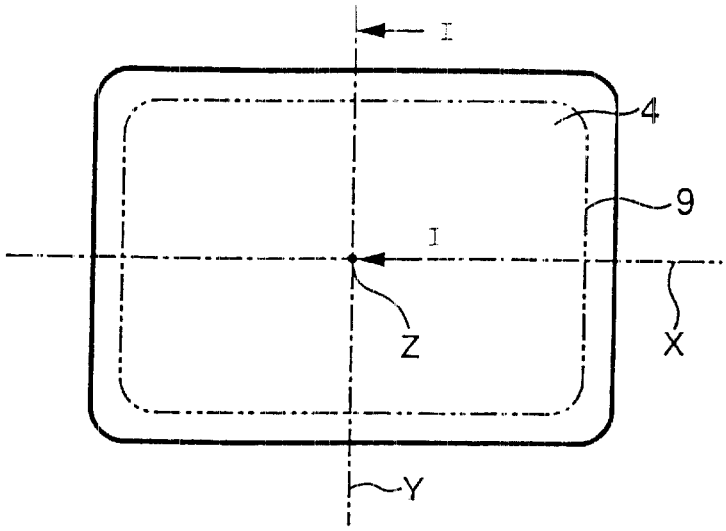
FIG. 2 is a plan view of a face portion of a panel portion.

Now, the present invention will be specifically described in reference to the accompanying drawings. FIG. 1 is a partial cross-sectional view of the glass bulb for a cathode ray tube according to an embodiment of the present invention, FIG. 2 is a plan view of a panel portion; and FIG. 1 is a cross-sectional view taken along line I—I of FIG. 2. In other words, FIG. 1 shows the sectional shape of a right half portion of the glass bulb taken along a short axis. In FIG. 2, symbols X and Y designate a long axis and the short axis of a face portion 4, respectively, and an imaginary line 9 designates a useful screen area in the face portion 4. In the glass bulb of this example, it is sufficient that the requirements of the present invention are specified on the panel portion and a funnel portion with respect to the short axis since an end portion of the useful screen area in the face portion 4 on the short axis has a greater wall thickness than an end portion of the useful screen area on the long axis. Now, the requirements will be described in detail.

As shown in FIG. 1, the glass bulb comprises the panel portion 1 and the funnel portion 2 having an end formed with a neck portion 3. The panel portion 1 includes the face portion 4 having a substantially flat outer surface and a concave inner surface, and an skirt portion 6 extending substantially vertically from a peripheral edge of the face portion. Thus, the panel portion has a hollow box-shaped form as a whole and has a blend portion 5 at a curved corner where the face portion 4 and the skirt portion 6 are connected each other. The phrase "substantially flat outer surface" means that the outer surface has a minimum radius of curvature of not shorter than 25,000 mm.

The funnel portion 2 comprises a body portion 7 formed in a funnel shape, a yoke portion 8 connected to the body portion and formed in a circular shape or a substantially rectangular shape in section perpendicular to a bulb axis Z, and the neck portion 3 sealed to the yoke portion. The body portion 7 has one end formed with a substantially rectangular sealing end surface, which is used for connection with an end surface of the skirt portion of the panel portion 1 by, e.g., frit glass. The one end of the body portion 7 is substantially the same as the end surface of the skirt portion of the panel portion in terms of shape and wall thickness, and the end surface has an equal wall thickness in the entire periphery.

The face portion 4 in the panel portion 1 has a wall thickness distribution in accordance with the shapes of the inner and outer surfaces of the face portion, and the wall thickness distribution greatly varies between a central portion and a peripheral portion of the face portion 4. Specifically, when $T_C$ is the wall thickness of the central portion of the face portion, and $T_L$ is the wall thickness of the edge portion 9 of the useful screen area, the formula of $1.70 \leqq T_L/T_C$ is established. This formula is applied when the panel portion extremely greatly varies in the wall thickness distribution in the face portion. In this formula, $T_L$ is the wall thickness of the edge portion 9 of the useful screen area in a direction parallel with the bulb axis Z. When the panel portion has a ratio of $T_L/T_C$ of less than 1.70, no fracture due to a thermal stress is caused even if the wall thickness of the skirt portion or the value of a thermally strengthened compressive stress is not specified. This is because the wall thickness distribution has a relatively small variance. Although the upper limit of $T_L/T_C$ is not specified, it is normally about 2.50 since the upper limit needs to be specified in accordance with the design specification of a cathode ray tube.

Now, the compressive stress applied to the panel portion 1 by thermal strengthening will be described. The panel portion 1 is thermally strengthened by a conventional method to apply a compressive stress to at least the outer surfaces of the face portion 4, the blend portion 5 and the skirt portion 6. This compressive stress is effective to avoid fracture due to a thermal stress or a vacuum stress produced in the panel portion since the compressive stress functions to cancel out the thermal stress or the vacuum stress. It is known that the magnitude of the applied compressive stress varies from location to location in the panel portion.

The present invention is provided on the basis that the compressive stress, which is applied to an area of the skirt portion 6 in the vicinity of a mold match 12 is quite effective to avoid fracture in a heat treatment process. The mold match 12 is formed by a mold and is normally located at a position of an outer lateral side of the skirt portion 6 adjacent to the blend portion 5. The position in the vicinity of mold match covers an area of the blend portion 5 near to the mold match and an upper portion of the skirt portion 6. A great tensile thermal stress is applied to the outer surface of the panel portion on cooling in the heat treatment process since the area in the vicinity of the mold match and the blended portion 5 have a great wall thickness.

The funnel portion is subjected to a greater heat contraction than the panel portion on cooling since the funnel portion has a smaller heat capacity than the panel portion and is cooled more rapidly than the panel portion accordingly. This heat contraction further increases the tensile thermal stress on the outer surface of the skirt portion in the panel portion since the heat contraction deforms the skirt portion so as to bend the skirt portion outwardly. This portion is likely to be damaged to lower the strength, and a tensile vacuum stress is also applied. This means that strengthening this part of the panel portion is effective to avoid the fracture.

From this viewpoint, the present invention is characterized in that the value $\sigma_C$ of a strengthened compressive stress in at least an area of a side surface of the skirt portion 6 in the vicinity of the mold match 12 is determined to satisfy the formula of $5\ \text{MPa} \leqq |\sigma_C| \leqq 14\ \text{MPa}$. The reason why the formula of $5\ \text{MPa} \leqq |\sigma_C| \leqq 14\ \text{MPa}$ needs to be satisfied is that when $|\sigma_C|$ is smaller than 5 MPa, the thermal stress or the tensile vacuum stress generated in the vicinity of the mold match can not be cancelled out in sufficient fashion, leading to insufficient prevention of breakage in the heat treatment process. When $|\sigma_C|$ is greater than 14 MPa, an imbalanced state in cooling is increased in a molding process of the panel portion, making uniform strengthening difficult. This leads to an increase in the rate of fracture in the heat treatment process. It is more preferable that $|\sigma_C|$ is equal to 7–11 MPa. The value of the strengthened compressive stress in the vicinity of the mold match is measured at an area of the skirt portion adjacent to the mold match portion as a matter of convenience.

In accordance with the present invention, the wall thickness $T_S$ of the sealing end surface of the skirt portion 6 is determined with respect to the wall thickness $T_L$ of the edge portion of the useful screen area so as to satisfy the formula of $0.43 \leqq T_S/T_L \leqq 0.50$. When $T_S/T_L \leqq 0.43$, the skirt portion becomes too thin, making it difficult to thermally strengthen the skirt portion 6 in reliable and sufficient fashion. When $T_S/T_L > 0.50$, the thermal stress increases to raise the rate of fracture and also to increase the mass. It is more preferable that the formula of $0.44 \leqq T_S/T_L \leqq 0.48$ is satisfied.

In accordance with the present invention, the wall thickness of the body portion 7 in the funnel portion 2 is made as thin as possible, making the funnel portion 2 lighter. In general, it is preferable from the viewpoint of reducing weight or cost that the wall thickness of the body portion 7 is thinner. However, when the wall thickness is too thin, the heat capacity decreases to increase the thermal stress as stated earlier, which creates a problem. Even when the body portion 7 in the funnel portion 2 has a thin wall thickness than convention ones, no problem can be created with respect to the thermal stress and the anti-implosion strength of the cathode ray tube by optimizing the wall thickness of the paired and sealed panel portion and funnel portion from the viewpoint of a generated stress in accordance with the present invention.

When the body portion 7 in the funnel portion 2 (the portion extending from the sealing end surface with the panel portion to the yoke portion 8) has a length of B in the bulb axis direction Z, the wall thickness at a location of B/2 satisfies the formula of $0.37 \leqq T_F/T_C \leqq 0.49$ in accordance with the present invention. By satisfying the formula of $T_F/T_C \geqq 0.37$, an increase in the thermal stress can be restrained. The restrained increase in the thermal stress works synergistically along with the thermally strengthening effect in enhancing the fracture prevention effect for the panel portion.

On the other hand, when $T_F/T_C < 0.37$, the cooling speed or the heating speed becomes extremely fast to increase the thermal stress, and additionally there is a possibility that the wall thickness of the body portion 7 is too thin to obtain a required strength. When $T_F/T_C > 0.49$, the mass of the funnel portion inconveniently increases in terms of marketability and economical efficiency, though an effect of decreasing the thermal stress is provided.

The reason why the wall thickness of the body portion 7 is determined at the location of B/2 is that an intermediate area of the body portion 7 is suited as the location for specifying the wall thickness of the body portion, which provides smooth continuation.

Figure 3:
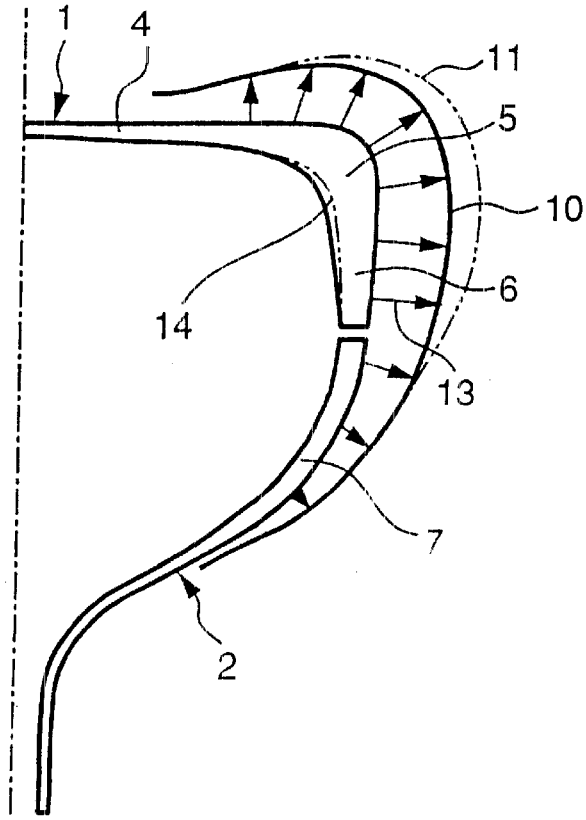
FIG. 3 is a schematic view of distributions of stresses (a thermal stress and a vacuum stress) generated in the glass bulb of FIG. 1.

FIG. 3 shows stresses at locations which are likely to be fractured particularly in the heat treatment process, with respect to stresses (which are a combination of a strengthened compressive stress, a thermal stress and a vacuum stress) generated in the glass bulb with the present invention applied thereto and a glass bulb having a thin-walled skirt portion 6. In FIG. 3, a solid line 10 indicates a stress distribution of the glass bulb according to the present invention as an example, and a chain double-dash line 11 indicates a stress distribution generated in a glass bulb, the wall thickness of which is not optimized since the skirt portion 6 is thin-walled as indicated by an imaginary line 14. Both stresses are tensile stresses, and the length of arrows 13 indicates magnitude. As seen from comparison of the solid line 10 with the chain double-dash line 11, the stress generated in the glass bulb with the present invention applied thereto is restrained to be made smaller.

Although explanation of the embodiment of the present invention has been made for the case wherein the edge portion of the useful screen area in the face portion on the short axis has a greater wall thickness, the glass bulb may be designed so that other portions than the portion on the short axis are determined at the same dimension or a smaller dimension.

EXAMPLE

With respect to glass bulbs for a 17-inch color cathode ray tube having an aspect ratio of 4:3, Examples of the present invention and Comparative Examples are shown in Table 1. In the Examples and the Comparative Examples, the face portions of all panel portions had substantially flat outer surface (the minimum radius of curvature of the outer surface–50,000 mm), and the wall thickness distribution of the face portions in the respective panel portions, i.e., the ratio $T_L/T_C$ of the wall thickness $T_L$ of the edge portion of the useful screen area in the face portions to the wall thickness $T_C$ of a central portion of the face portions were all 1.8. Since the wall thickness of the edge portion of the useful screen area in the face portions in the employed panel portions is thicker on the long axis than on the short axis, the wall thickness of the edge portion of the useful screen area on the long axis was defined as $T_L$. All panel portions except for the panel portion in the Comparative Example 1 were manufactured under the same strengthening condition. The rate of fracture was estimated by arranging the relation of stresses at the respective portions of glass and a rate of the occurrence of breakage according to the Weibull statistical method and statistically dealing with the arranged relation throughout the outer surface of glass bulbs. In Table 1, the M strengthened compressive stress means the strengthened compressive stress in the vicinity of the mold matches, and the unit of the wall thickness is all mm. The position of the edge portion of the useful screen area is determined according to Japanese Electronics and Information Technology Industries Association Standard EIAJ ED-2136B.

In each of Examples 1–3, the rate of fracture was maintained within an allowable range since the thermal stress was successfully restrained from increasing. In the Comparative Example 1, although the mass of the funnel portion was light, the value of the strengthened compressive stress in the vicinity of the mold match was substantially zero because of being not strengthened, and the rate of fracture was extremely high since the thermal stress was great. In the Comparative Example 2, although the strengthened compressive stress showed a typical value, a great thermal stress was generated to raise the rate of fracture since the entire glass bulb was not properly balanced. In the Comparative Example 3, an increase in the wall thickness of the body portion in the funnel portion restrained the thermal stress in a low level to reduce the rate of fracture, though the mass was heavy.

TABLE 1

| Condition | Example 1 | Example 2 | Example 3 | Comparative Example 1 | Comparative Example 2 | Comparative Example 3 |
|---|---|---|---|---|---|---|
| Wall thickness $T_c$ in central portion of face portion | 11.0 | 11.0 | 11.0 | 11.0 | 11.0 | 11.0 |
| Wall thickness $T_L$ in edge portion of useful screen area on long axis | 20.2 | 20.2 | 20.2 | 20.2 | 20.2 | 20.2 |
| Wall thickness $T_L$ in edge portion of useful screen area on short axis | 15.6 | 15.6 | 15.6 | 15.6 | 15.6 | 15.6 |
| $T_L/T_C$ | 1.8 | 1.8 | 1.8 | 1.8 | 1.8 | 1.8 |
| Wall thickness $T_S$ of sealing end surface | 8.7 | 9.2 | 8.7 | 8.0 | 8.0 | 8.7 |
| $T_S/T_L$ | 0.43 | 0.46 | 0.43 | 0.40 | 0.40 | 0.43 |
| Wall thickness $T_F$ of body portion | 4.5 | 4.5 | 5.0 | 4.0 | 4.0 | 6.0 |
| $T_F/T_C$ | 0.41 | 0.41 | 0.46 | 0.36 | 0.36 | 0.55 |
| M strengthened compressive stress $\sigma_c$ MPa) | −8.0 | −9.5 | −8.0 | 0.0 | −6.0 | −8.0 |
| Thermal stress (MPa) | 28.0 | 28.0 | 27.0 | 31.0 | 31.0 | 25.0 |
| Estimated rate of fracture (%) | 0.21 | 0.15 | 0.17 | 1.00 | 0.51 | 0.11 |
| Mass of funnel (kg) | 2.8 | 2.8 | 2.9 | 2.7 | 2.7 | 3.1 |

With respect to glass bulbs for a 29-inch cathode ray tube having an aspect ratio of 4:3, Examples 4 and 5 were shown along with Comparative Examples 4 and 5 in Table 2 as in the Examples 1–3. In the panel portion employed in each of these Examples and Comparative Examples, the wall thickness on the short axis was defined as $T_L$ since the wall thickness of the edge portion in the useful screen area on the short axis was greater than that on the long axis. As clearly seen from the Table 2, in each of the Examples 4 and 5, the rate of fracture was within an allowable range since the thermal stress was successfully restrained. On the other hand, in the Comparative Example 4, the thermal stress was increased to raise the rate of fracture. In the Comparative Example 5, although the rate of fracture was low, the mass of the funnel portion was significantly increased.

TABLE 2

| Condition | Example 4 | Example 5 | Comparative Example 4 | Comparative Example 5 |
|---|---|---|---|---|
| Wall thickness $T_C$ in central portion of face portion | 12.5 | 12.5 | 12.5 | 12.5 |
| Wall thickness in edge portion of useful screen area on long axis | 20.3 | 20.3 | 20.3 | 20.3 |
| Wall thickness $T_L$ in edge portion of useful screen area on short axis | 24.6 | 24.6 | 24.6 | 24.6 |
| $T_L/T_C$ | 2.0 | 2.0 | 2.0 | 2.0 |
| Wall thickness $T_S$ of sealing end surface | 11.8 | 10.5 | 10.0 | 11.8 |
| $T_S/T_L$ | 0.480 | 0.427 | 0.407 | 0.480 |
| Wall thickness $T_F$ of body portion | 6.0 | 6.0 | 4.5 | 7.3 |
| $T_F/T_C$ | 0.480 | 0.480 | 0.360 | 0.584 |
| M strengthened compressive stress $\sigma_c$ MPa) | −6.5 | −5.0 | −4.0 | −6.5 |
| Thermal stress (MPa) | 28.0 | 28.0 | 30.0 | 26.0 |
| Estimated rate of fracture (%) | 0.23 | 0.28 | 0.68 | 0.21 |
| Mass of funnel (kg) | 8.6 | 8.3 | 8.2 | 9.6 |

In accordance with the present invention, when the panel portion that has a greatly changed wall thickness distribution in the face portion, is combined with the funnel portion to produce a cathode ray tube, the wall thickness of the skirt portion is properly determined based on the width of the sealing end surface with respect to the wall thickness around the face portion as explained. As a result, the thermal stress generated in the glass bulb in a heat treatment process can be restrained, and a compressive stress can be effectively applied by thermal strengthening. Thus, this occurrence of the fracture of the glass bulb can be prevented or decreased.

In addition, the thermal stress affected by the funnel portion can be minimized since the wall thickness of the body portion in the funnel portion is properly determined with respect to the wall thickness of the central portion in the face portion. Thus, the occurrence of the fracture of the glass bulb in the heat treatment process can be prevented or restrained, and simultaneously the funnel portion can be made lighter while the glass bulb maintains a required strength. In accordance with the application of the present invention, the panel portion can have a thinner wall thickness in the face portion than conventional panel portions without lowering productivity.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application No. 2001-69100 filed on Mar. 12, 2001 including specification, claims, drawings and summary are incorporated herein by reference in its entirety.

What is claimed is:

1. A glass bulb for a cathode ray tube, comprising:

a panel portion having a rectangular face portion and a skirt portion, the rectangular face portion having a substantially flat outer surface and a concave inner surface, the skirt portion extending substantially vertically from a peripheral edge of the face portion;

a funnel portion having one end connected to the panel portion; and a neck portion having connected to the other end of the funnel portion;

wherein at least the panel portion being thermally strengthened to apply a compressive stress thereto;

the panel portion satisfies the following conditions at an edge portion of a useful screen area in the face portion on a short axis or an edge portion of a useful screen area in the face portion on a long axis, whichever has a greater wall thickness:

1) $1.70 \leqq T_L/T_C$, wherein $T_C$ is a central wall thickness of the face portion, and $T_L$ is a wall thickness of the useful screen area, 2) $5\ \text{MPa} \leqq |\sigma_C| \leqq 14\ \text{MPa}$, wherein $\sigma_C$ is the value of a strengthened compressive stress in at least an area of a side surface of the skirt portion in the vicinity of a mold match, and 3) $0.43 \leqq T_S/T_L \leqq 0.50$, wherein $T_S$ is a wall thickness of a sealing end surface of the skirt portion;

the funnel portion satisfies the following condition:

4) $0.37 \leqq T_F/T_C \leqq 0.49$, wherein $T_F$ is a wall thickness at a portion located at B/2 when B is the length of a body portion in the funnel portion in a bulb axis direction, the body portion extending from a sealing end to a yoke portion thereof.

2. A cathode ray tube produced by employing the panel portion and the funnel portion defined in claim 1.

* * * * *